US006349647B1

(12) United States Patent
Elgee

(10) Patent No.: US 6,349,647 B1
(45) Date of Patent: Feb. 26, 2002

(54) APPARATUS AND METHOD FOR DRYING PRINTING COMPOSITION ON A PRINT MEDIUM

(75) Inventor: Steven B. Elgee, Portland, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/659,667

(22) Filed: Sep. 11, 2000

(51) Int. Cl.[7] ..... B41F 21/00
(52) U.S. Cl. ..... 101/416.01; 400/120.01
(58) Field of Search ..... 101/416.1; 400/120.01, 400/120.08

(56) References Cited

U.S. PATENT DOCUMENTS

| | | | |
|---|---|---|---|
| 4,207,579 | A | 6/1980 | Gamblin et al. |
| 4,447,817 | A | 5/1984 | Naramore |
| 4,821,049 | A | 4/1989 | Eckl |
| 4,872,027 | A | 10/1989 | Buskirk et al. |
| 5,342,133 | A | 8/1994 | Canfield |
| 5,345,863 | A | 9/1994 | Kurata et al. |
| 5,419,644 | A | 5/1995 | Martin et al. |
| 5,428,383 | A | 6/1995 | Shields et al. |
| 5,668,584 | A | 9/1997 | Broder et al. |

FOREIGN PATENT DOCUMENTS

| | | | |
|---|---|---|---|
| EP | 0640479 B1 | | 6/1999 |
| JP | 60048385 | | 3/1985 |
| JP | 05112001 | | 5/1993 |
| JP | 6-325864 | * | 11/1994 |
| JP | 07304167 | | 11/1995 |
| JP | 410333489 A | * | 12/1998 |
| WO | WO 97/28003 | | 8/1997 |

* cited by examiner

*Primary Examiner*—John S. Hilten
*Assistant Examiner*—Charles H. Nolan, Jr.
(74) *Attorney, Agent, or Firm*—Erik A. Anderson

(57) ABSTRACT

A printing device, inductive heating device, and method are disclosed. An embodiment of the printing device includes a printing mechanism for printing an image on a print medium, a metal belt for transporting the print medium, and an induction heater positioned adjacent the metal belt, the induction heater being configured to induce an alternating current in an area of the metal belt adjacent the induction heater, the alternating current uniformly heating the area of the metal belt adjacent the induction heater. An embodiment of the inductive heating device includes a power source and a coil coupled to the power source to produce a varying magnetic field around the coil and positioned adjacent the metal belt to induce an alternating current in an area of the metal belt through which the varying magnetic field passes, the alternating current uniformly heating the area of the metal belt. An embodiment of the method includes generating a varying magnetic flux through an area of the metal belt, inducing an alternating current in the area of the metal belt through which the magnetic flux passes, and uniformly heating the area of the metal belt through which the magnetic flux passes. Further characteristics and features of the printing device, inductive heating device, and method are disclosed herein.

20 Claims, 6 Drawing Sheets

APPARATUS AND METHOD FOR DRYING PRINTING COMPOSITION ON A PRINT MEDIUM

BACKGROUND AND SUMMARY

The present invention relates to printing devices. More particularly, the present invention relates to an apparatus and method for drying printing composition on a print medium.

Printing devices, such as ink jet printers and laser printers, use printing composition (e.g., ink or toner) to print images (text, graphics, etc.) onto a print medium in a printzone of the printing device. Inkjet printers may use print cartridges, also known as "pens", which shoot drops of printing composition, referred to generally herein as "ink", onto a print medium such as paper, transparency or cloth. Each pen has a printhead that includes a plurality of nozzles. Each nozzle has an orifice through which the drops are ejected. To print an image, the printhead is propelled back and forth across the page by, for example, a carriage while ejecting drops of ink in a desired pattern as the printhead moves. The particular ink ejection mechanism within the printhead may take on a variety of different forms known to those skilled in the art, such as thermal printhead technology. For thermal printheads, the ink may be a liquid, with dissolved colorants or pigments dispersed in a solvent.

In a current thermal system, a barrier layer containing ink channels and vaporization chambers is located between an orifice plate and a substrate layer. This substrate layer typically contains linear arrays of heating elements, such as resistors, which are energized to heat ink within the vaporization chambers. Upon heating, the ink in the vaporization chamber turns into a gaseous state and forces or ejects an ink drop from a orifice associated with the energized resistor. By selectively energizing the resistors as the printhead moves across the print medium, the ink is expelled in a pattern onto the print medium to form a desired image (e.g., picture, chart or text).

In order for the image to be fixed to the print medium so that it will not smear, the printing composition must be dried. The printing composition is dried by a combination of the solvent evaporating and the solvent absorbing into the print medium, both of which take time. Various factors control the amount of time required for a particular printing composition to dry. These factors include the type of print medium, the quantity of solvent in an printing composition, the amount of printing composition on the print medium, and ambient temperature and humidity. Ideally, the printing composition will be fixed to the print medium quickly to help prevent image smear, print medium cockle (print medium buckle toward a printhead), and print medium curl (curling along at least one edge of a print medium), as well as to help maximize printing device throughput.

To reduce the amount of this time, the surface of some types of print media may be specially coated to help speed drying. Other means may also be used such as special chemicals, generally know as "fixers", that are applied to print media before or after printing.

Each of these above-described techniques have certain disadvantages. For example, specially coated print media may be relatively more expensive than uncoated print media. Fixers may become depleted during printing, resulting in no fixer being applied for the remainder of a print job, possibly causing some or all of the aforementioned problems, or the stopping of a print job to supply additional fixer, resulting in decreased printing device throughput and possible color hue shift on any print medium for which printing was halted.

An apparatus and method that decreased the amount of time required to dry or fix printing composition to a print medium while avoiding the above-described problems associated with other techniques would be a welcome improvement. Accordingly, the present invention is directed to drying printing composition on a print medium quickly to help prevent image smear, print media cockle, and print media curl. The present invention is also directed to helping maximize printing device throughput. The present invention is additionally directed to eliminating the need for specially coated media and fixers to accelerate drying.

Accordingly, an embodiment of a printing device in accordance with the present invention includes a printing mechanism for printing an image on a print medium and a metal belt for transporting the print medium. The printing device also includes an induction heater positioned adjacent the metal belt, the induction heater being configured to induce an alternating current in an area of the metal belt adjacent the induction heater, the alternating current uniformly heating the area of the metal belt adjacent the induction heater.

The above-described embodiment of a printing device in accordance with the present invention may be modified and include the following characteristics, as described below. The alternating current may be induced in the area of the metal belt adjacent the induction heater irrespective of movement of the metal belt. The printing mechanism may comprise an inkjet printhead.

An alternative embodiment of a printing device in accordance with the present invention includes structure for printing an image on a print medium and metallic structure for transporting the print medium. The printing device additionally includes structure for generating a varying magnetic flux through an area of the metallic structure for transporting that induces an alternating current in the area thereby uniformly heating the area.

The above-described alternative embodiment of a printing device in accordance with the present invention may be modified and include the following characteristics, as described below. The structure for printing may comprise an inkjet printhead. The metallic structure for transporting may comprise a metal belt. The structure for generating may comprise an induction heater positioned adjacent the metallic structure for transporting. The alternating current may be induced in the area of the metallic structure for transporting irrespective of movement of the metallic structure for transporting.

An embodiment of a method for use in a printing device, the printing device including a printing mechanism for printing an image on a print medium and a metal belt for transporting the print medium, includes generating a varying magnetic flux through an area of the metal belt. The method additionally includes inducing an alternating current in the area of the metal belt through which the varying magnetic flux passes and substantially uniformly heating the area of the metal belt through which the varying magnetic flux passes.

The above-described embodiment of a method in accordance with the present invention may be modified and include the following characteristics, as described below. A magnitude of the magnetic flux may be varied through the area of the metal belt. Alternatively or additionally, a direction of the magnetic flux may be varied through the area of the metal belt. The method may additionally include transferring heat from the area of the metal belt to the print medium to fix the image on the print medium. The alternating current may be induced in the area of the metal belt through which the varying magnetic flux passes irrespective of movement of the metal belt.

An embodiment of an inductive heating device in accordance with the present invention for use in a printing device, the printing device including a metal belt for transporting the print medium, includes a power source and a coil. The coil is coupled to the power source to produce a varying magnetic field around the coil and positioned adjacent the metal belt to induce an alternating current in an area of the metal belt throug which the varying magnetic field passes, the alternating current uniformly heating the area of the metal belt.

The above-described embodiment of an inductive heating device in accordance with the present invention may be modified and include the following characteristics, as described below. A magnitude of the magnetic field may vary. Alternatively or additionally, a direction of the magnetic field may vary. The alternating current may be induced in the area of the metal belt irrespective of movement of the metal belt.

With respect to each of the above-described embodiments, as well as others in accordance with the present invention, at least the following advantages are noted. The use of a metal belt or metallic structure for transporting is less expensive and complex to manufacture than a non-metal belt with electrical conductors, such as metallic wire loops, embedded or defined therein. Also, a metal belt or metallic structure for transporting is electrically conductive over its whole surface area, thereby providing more substantially uniform heating throughout than a non-metal belt with electrical conductors embedded or defined therein which tends to provide more localized heating in the areas adjacent the conductors. Additionally, induction heating in accordance with the present invention does not require movement of the metal belt or metallic means for transporting because a varying magnetic flux may be generated by changing an intensity and/or direction of a magnetic field through an area of the metal belt or metallic means for transporting. Furthermore, induction heating in accordance with the present invention does not require physical contact between the metal belt and the heating device, as with conductive heating designs, where substantially uniform physical contact is required between the metal belt and the heating device in order for heat transfer to occur. The requirement for such substantially uniform physical contact adds tolerance requirements to such conductive heating device designs. Elimination of the requirement of physical contact for heat transfer to occur and its associated tighter tolerances, helps reduce the complexity and cost of the present invention, as well as increase its operational efficiency.

The foregoing summary is not intended by the inventors to be an inclusive list of all the aspects, advantages, and features of the present invention, nor should any limitation on the scope of the invention be implied therefrom. This summary is provided in accordance with 37 C.F.R. Section 1.73 and M.P.E.P. Section 608.01(d). Additionally, it should be noted that the use of the word substantially in this document is used to account for things such as engineering and manufacturing tolerances, as well as variations not affecting performance of the present invention. Other objects, advantages, and novel features of the present invention will become apparent from the following detailed description of the invention when considered in conjunction with the accompanying drawings.

DETAILED DESCRIPTION OF THE DRAWINGS

Figure 1:
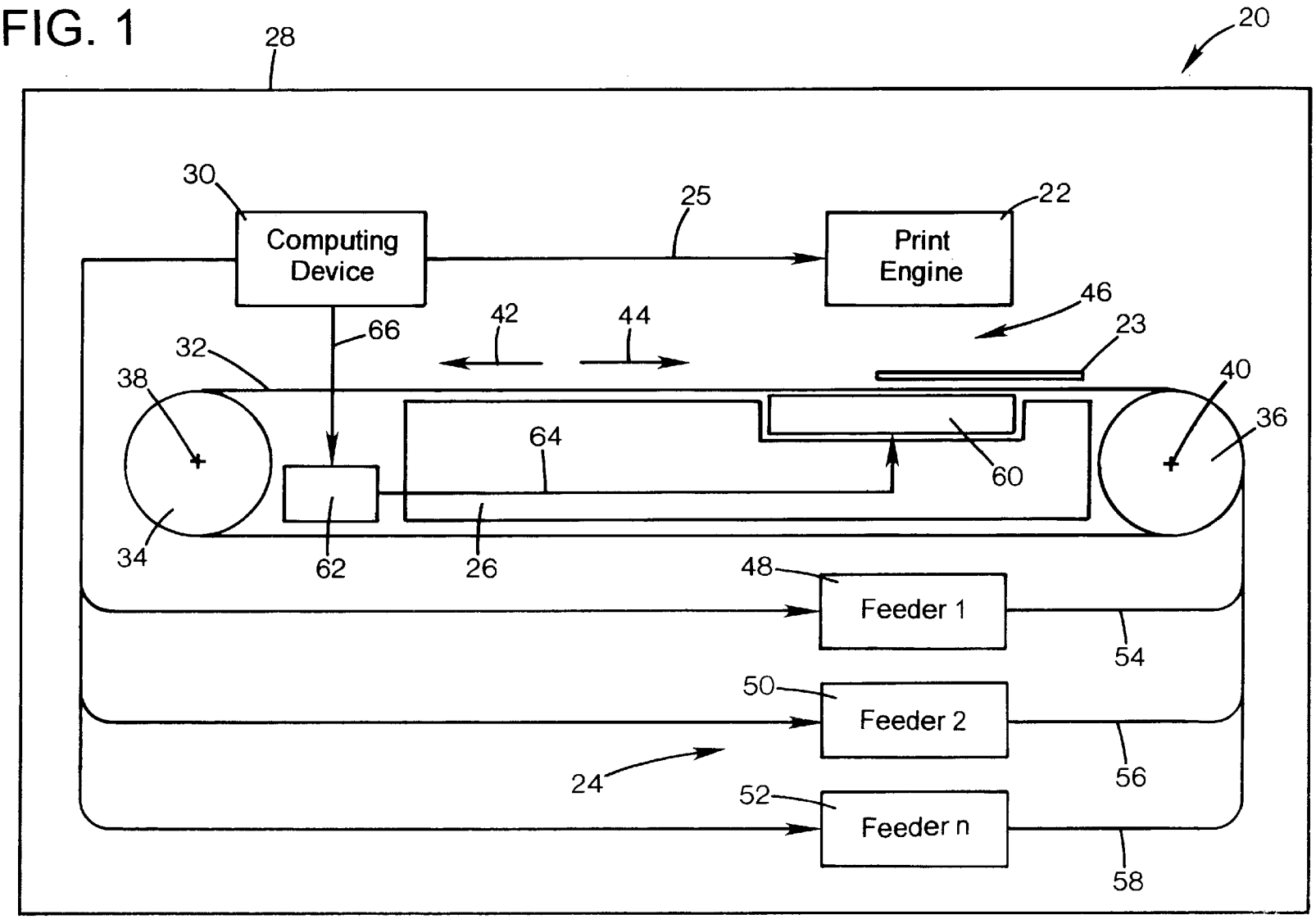
FIG. 1 is a diagrammatic view of a printing device that includes an embodiment of the present invention.

FIG. 1 illustrates a diagrammatic view of an inkjet printing device 20 that includes an embodiment of the present invention and which may be used for printing business reports, correspondence, desktop publishing, and the like. A variety of printing devices are commercially available. For instance, some of the printing devices that may embody the present invention include printers, plotters, copiers, and facsimile machines, to name a few, as well as various combination devices, such as combination facsimiles and printers. In addition, the present invention may be used in a variety of types of printing devices such as inkjet printers and laser printers.

Some of the major elements of printing device 20 are shown in FIG. 1, including print engine 22, print media handling system 24, vacuum platen 26, and housing or casing 28. Print engine 22 may comprise any type of apparatus by which an image is recorded on print medium 23, including inkjet printing mechanisms and laser mechanisms. A computing device 30 is used to control formation of images on print medium 23 by print engine 22, as generally indicated by arrow 25. Computing device 30 often receives instructions from a host device, typically a computer, such as a personal computer (not shown). Many of the functions of computing device 30 may be performed by a host computer (not shown), including any printing device 20 drivers resident on the host computer, by electronics in printing device 20, or by interactions between the host computer and the electronics. As used herein, the term "computing device 30" encompass these functions, whether performed by a host device, printing device 20, an intermediary device between the host device and printing device 20, or by combined interaction of such elements.

Print media handling system 24 includes a metal belt 32 that is disposed around a pair of driven rollers 34 and 36. Rollers 34 and 36 may be selectively driven by computing device 30 of printing device 20 and one or more motors and drive gears (which are not shown) so as to rotate about points 38 and 40 in either a clockwise or counter-clockwise direction which allows metal belt 32 to selectively move in either of the directions indicated by arrows 42 and 44. Metal belt 32 is in fluid communication with vacuum platen 26 by, for example, a plurality of apertures (not shown) formed though metal belt 32. In this manner, print medium 23 is held against metal belt 32 for the span of the length of vacuum platen 26 and can be moved to and from printzone 46 any number of times. This span may be changed by resizing the dimensions of vacuum platen 26.

As can also be seen in FIG. 1, print media handing system 24 includes a plurality of print media feeders 48, 50, and 52. Feeders 48, 50, and 52 each include a tray for sheets of print media or a rack for a roll of print media, as well as the necessary components to transport print media to printzone 46 of printing device 20 for printing by print engine 22 via print media feed paths 54, 56, and 58. Feeders 48, 50, and 52 may each be separately configured to hold various sized print media or, alternatively, fixed sized print media. Computing device 30 of printing device 20 is also coupled to each of feeders 48, 50, and 52 to control selective transport of print media from any one of feeders 48, 50, and 52 to printzone 46 for printing of images by print engine 22. The present invention may be used with printing devices having any number of print media input trays and/or racks which is noted in FIG. 1 through the use of the designation "Feeder n" for feeder 52.

As can additionally be seen in FIG. 1, printing device 20 includes an inductive heating device 60, in accordance with the present invention, positioned as shown so as to apply heat energy to print medium 23 via induction to heat any printing composition on print medium 23, as more fully discussed below. Inductive heating device 60 receives energy from power source 62, as generally indicated by arrow 64 in FIG. 1. Power source 62 is controlled by computing device 30 to supply energy to heating device 60, as generally indicated by arrow 66 in FIG. 1.

Figure 2:
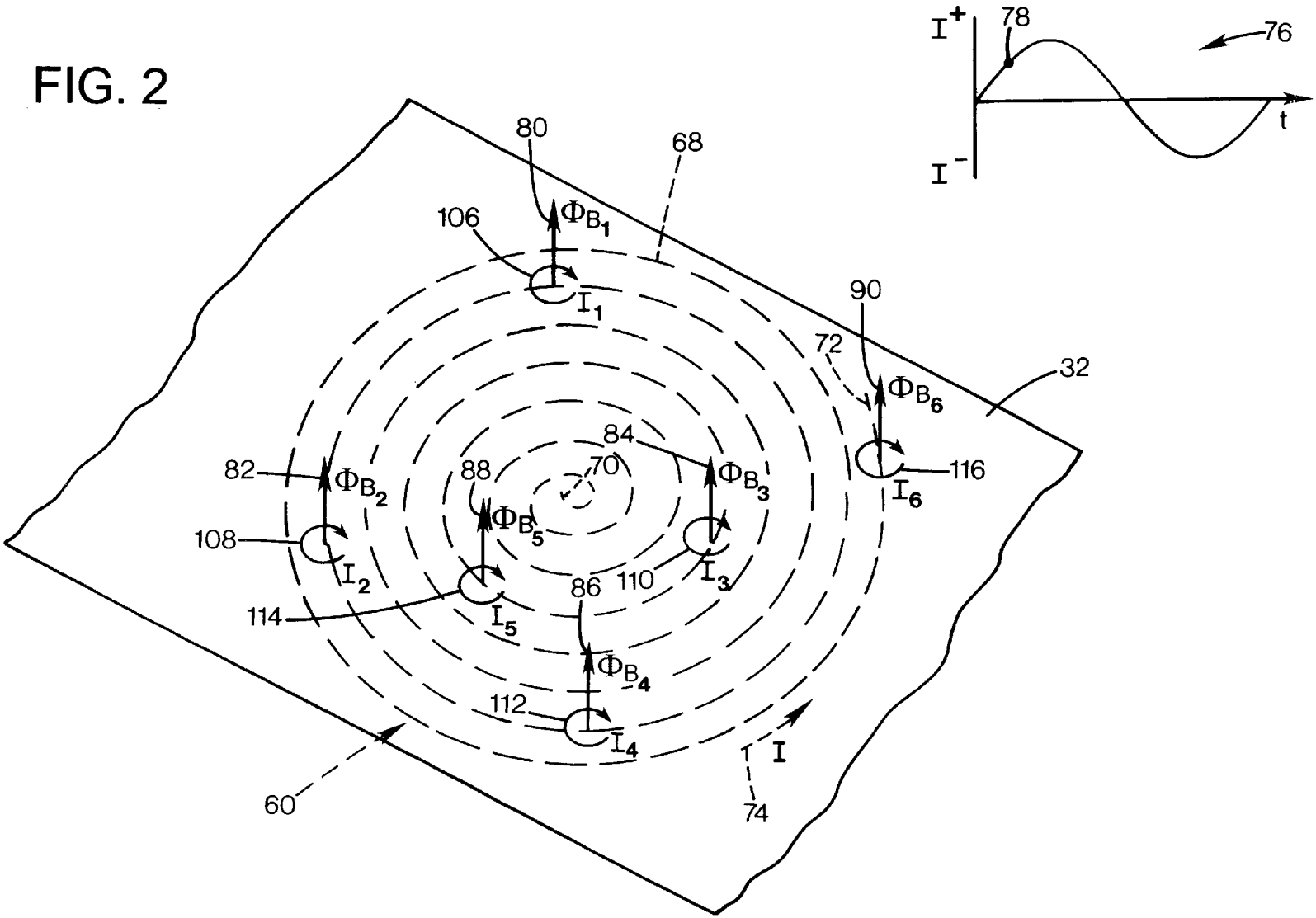
FIG. 2 is a diagrammatic view of induction heating in accordance with the present invention.

A diagrammatic view of induction heating in accordance with the present invention is shown in FIG. 2. As can be seen in FIG. 2, a portion of metal belt 32 in the area of printzone 46 is shown, as is inductive heating device 60. As can also be seen in FIG. 2, inductive heating device 60 includes a coil 68 that is positioned underneath and adjacent metal belt 32. Coil 68 is electrically conductive and includes a first end 70 coupled to power source 62 (see FIG. 1) as well as a second end 72 also coupled to power source 62 so that application of a voltage across respective first and second ends 70 and 72 of coil 68 by power source 62 produces a current (I), which is generally represented in FIG. 2 by arrow 74.

As current (I) travels through heating device 60, a magnetic field is created around coil 68. Magnetic fields are typically represented by the letter B and are vector quantities, having both magnitude and direction. The magnitude of this magnetic field is proportional to the amount of current (I), being greater for a larger current and less for a smaller current. The quantity of current (I) is controlled by the amount of voltage applied across respective first and second ends 70 and 72 of coil 68. The direction of the magnetic field is dependent on the direction of current flow in coil 68. The direction of current flow in coil 68 is in turn determined by the polarity of the voltage applied across respective first and second ends 70 and 72 of coil 68.

In operation in accordance with the present invention, a sinusoidal alternating current (AC) voltage is applied across respective first and second ends 70 and 72 of coil 68 by power source 62. This sinusoidal voltage varies with time between a maximum value and a minimum value, and produces a current flow (I) through coil 68, generally represented by arrow 74 and graph 76 in FIG. 2. As can be seen by reviewing graph 76 in FIG. 2, current (I) varies with time between a maximum positive value ($I^+$) and a maximum negative value ($I^-$). At point 78 of graph 76, current (I) represented by arrow 74 in FIG. 2 flows through coil 68. As discussed above, this current (I) produces a magnetic field around the entire length of coil 68. This magnetic field around coil 68 substantially uniformly flows through the area of metal belt 32 adjacent coil 68 as a magnetic flux ($\Phi_B$), which is generally represented in FIG. 2 at selected points of metal belt 32 by $\Phi_{B1}$, $\Phi_{B2}$, $\Phi_{B3}$, $\Phi_{B4}$, $\Phi_{B5}$, and $\Phi_{B6}$ and respective arrows 80, 82, 84, 86, 88, and 90. For the current (I) shown in FIG. 2, the magnetic flux through metal belt 32 has an magnitude represented by the lengths of arrows 80, 82, 84, 86, 88, and 90 in FIG. 2.

Figure 3:
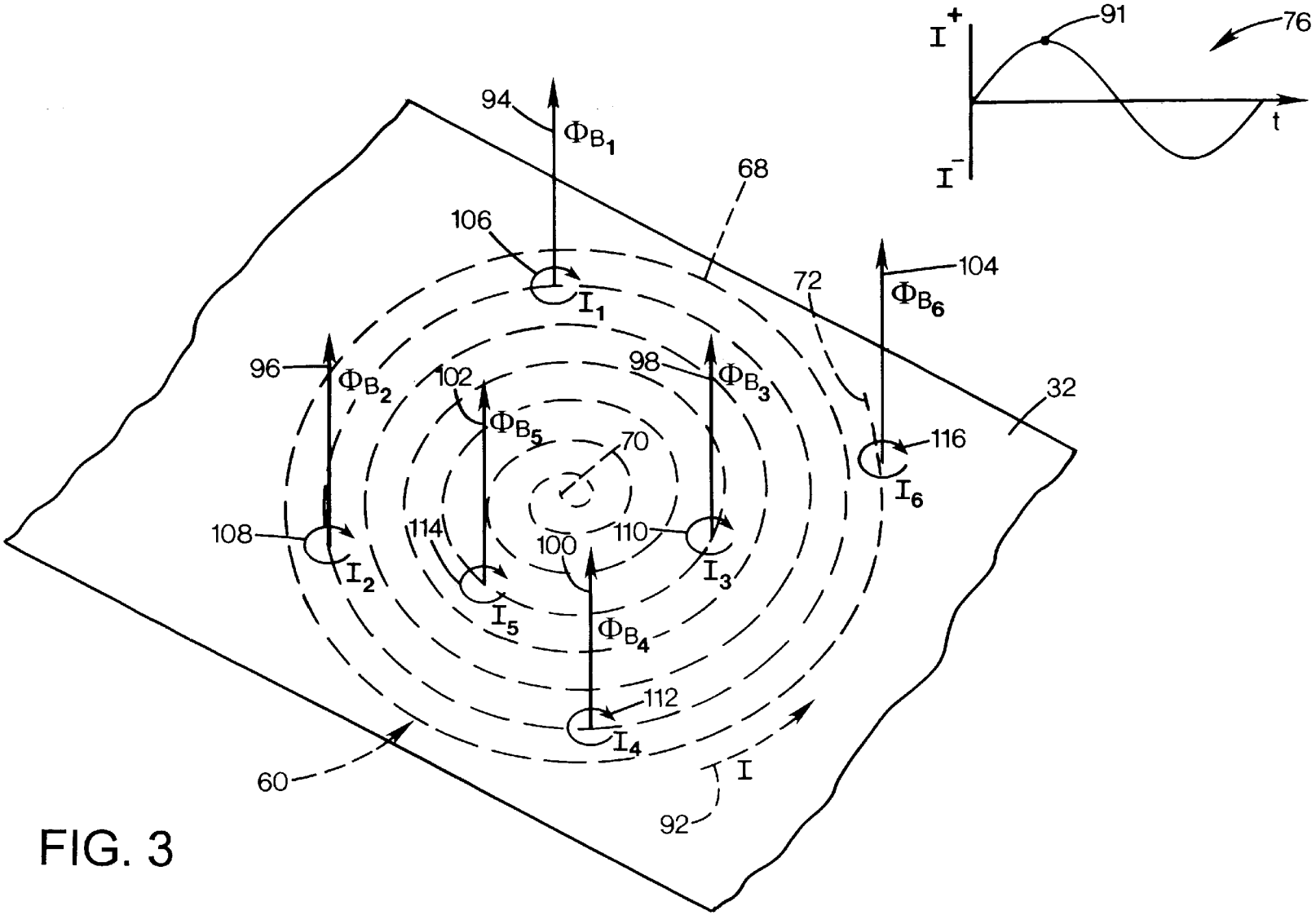
FIG. 3 is another diagrammatic view of induction heating in accordance with the present invention.

A diagrammatic view of induction heating in accordance with the present invention is shown in FIG. 3 for a different value of applied sinusoidal AC voltage. This different value of applied sinusoidal voltage produces a larger current ($I^+$) flowing in coil 68, as generally indicated by the larger arrow 92 and point 91 of graph 76 in FIG. 3, than the current (I) flowing in coil 68 and represented by arrow 74 and point 78 of graph 76 in FIG. 2. This relatively larger current (I) produces a relatively larger magnetic field around the entire length of coil 68. This relatively larger magnetic field around coil 68 substantially uniformly flows through the area of metal belt 32 adjacent coil 68 as a magnetic flux ($\Phi_B$), which is generally represented in FIG. 3 at selected points of metal belt 32 by $\Phi_{B1}$, $\Phi_{B2}$, $\Phi_{B3}$, $\Phi_{B4}$, $\Phi_{B5}$, and $\Phi_{B6}$ and respective arrows 94, 96, 98, 100, 102, and 104. As can be seen in FIG. 3, the flux through metal belt 32 has a larger magnitude than the flux through metal belt 32 in FIG. 2, as represented by the longer lengths of arrows 94, 96, 98, 100, 102, and 104 in FIG. 3 versus the lengths of arrows 80, 82, 84, 86, 88, and 90 in FIG. 2.

As can be seen by comparing FIGS. 2 and 3, the sinusoidal AC voltage applied to coil 68 via power supply 62, produces a substantially uniform magnetic flux ($\Phi_B$) through an area of metal belt 32 adjacent induction heater 60 that varies in magnitude over time. According to Faraday's law, this varying magnetic flux induces a varying voltage in the area of metal belt 32 adjacent induction heater 60 that is proportional to the rate of change of this magnetic flux ($\Phi_B$). According to Ohm's law, this varying voltage in turn produces a varying current in metal belt 32 that has a magnitude proportional to the induced varying voltage and dependent on the resistance of metal belt 32. This current flows substantially uniformly throughout the area of metal belt 32 through which the magnetic flux ($\Phi_B$) from coil 68 passes and is generally represented at various points on metal belt 32 in FIGS. 2 and 3 by eddy currents $I_1$, $I_2$, $I_3$, $I_4$, $I_5$, and $I_6$ and respective arrows 106, 108, 110, 112, 114, and 116. As this current flows, it substantially uniformly heats the area of the metal belt through which the magnetic flux ($\Phi_B$) passes, this heat is in turn transferred to print medium 23 to dry printing composition deposited thereon by print engine 22.

Figure 4:
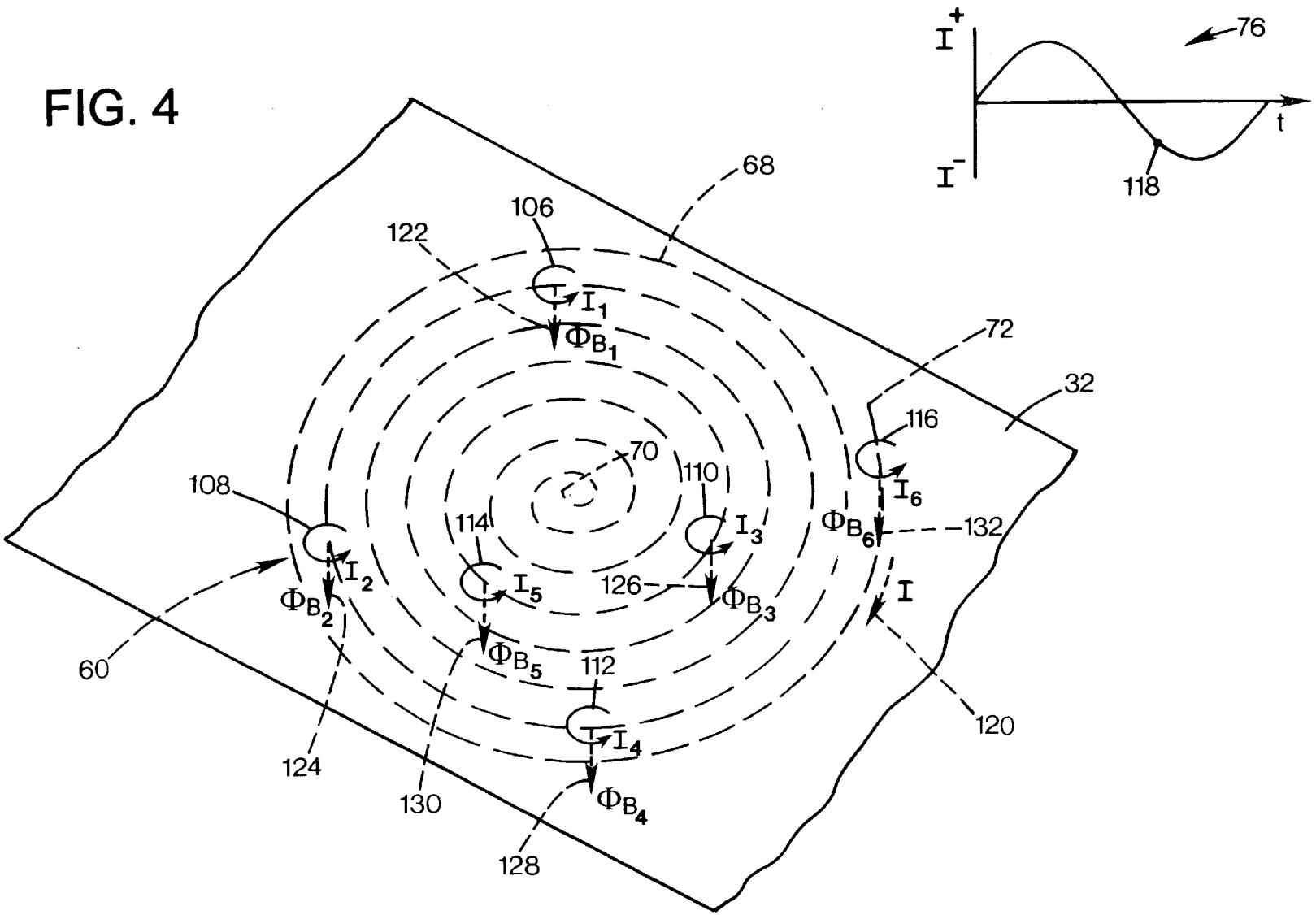
FIG. 4 is an additional diagrammatic view of induction heating in accordance with the present invention.

An additional diagrammatic view of induction heating in accordance with the present invention is shown in FIG. 4 for another different value of applied sinusoidal AC voltage. As can be seen in FIG. 4, this value of applied sinusoidal voltage produces a negative current (I) flowing in coil 68, as generally indicated by arrow 120, which points in the opposite direction of arrows 74 and 92, and point 118 of graph 76. This negative current (I) also produces a magnetic field around coil 68 that substantially uniformly flows through the area of metal belt 32 adjacent coil 68 as a magnetic flux ($\Phi_B$), which is generally represented in FIG. 4 at selected points of metal belt 32 by $\Phi_{B1}$, $\Phi_{B2}$, $\Phi_{B3}$, $\Phi_{B4}$, $\Phi_{B5}$, and $\Phi_{B6}$ and respective arrows 122, 124, 126, 128, 130, and 132.

Figure 5:
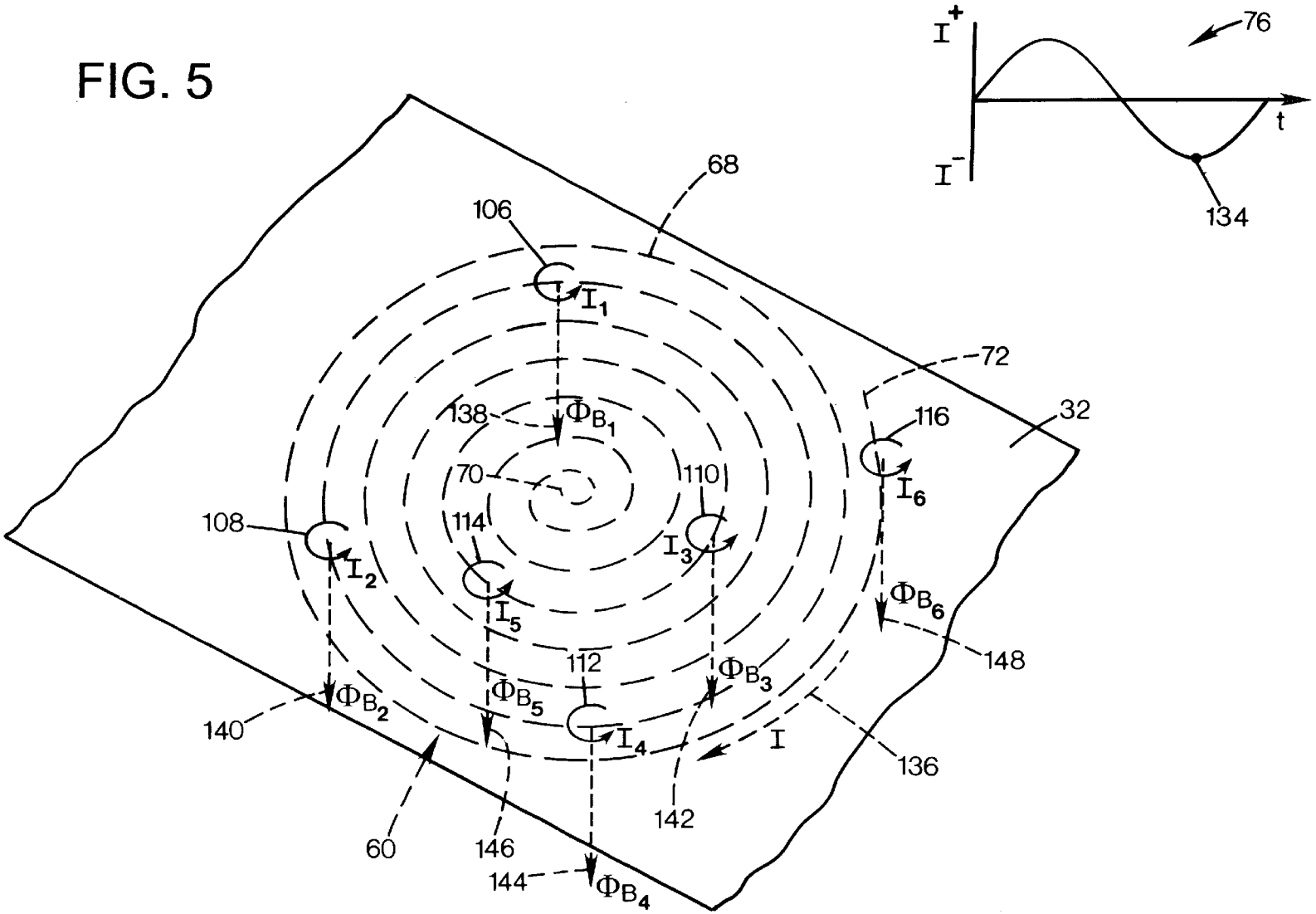
FIG. 5 is a further diagrammatic view of induction heating in accordance with the present invention.

A further diagrammatic view of induction heating in accordance with the present invention is shown in FIG. 5 for yet another different value of applied sinusoidal AC voltage. As can be seen in FIG. 5, this value of applied sinusoidal AC voltage produces a larger negative current ($I^-$) flowing in coil 68, as generally indicated by the larger arrow 136 and point 134 of graph 76, than the negative current (I) flowing in coil 68 and represented by arrow 120 and point 118 in FIG. 4. This relatively larger negative current (I) produces a relatively larger magnetic field around the entire length of coil 68. This relatively larger magnetic field around coil 68 substantially uniformly flows through the area of metal belt 32 adjacent coil 68 as a magnetic flux ($\Phi_B$), which is generally represented in FIG. 5 at selected points of metal belt 32 by $\Phi_{B1}$, $\Phi_{B2}$, $\Phi_{B3}$, $\Phi_{B4}$, $\Phi_{B5}$, and ($\Phi_{B6}$ and respective arrows 138, 140, 142, 144, 146, and 148. As can be seen in FIG. 5, the flux through metal belt 32 has a larger magnitude than the magnetic flux through metal belt 32 in FIG. 4, as represented by the longer lengths of arrows 138, 140, 142, 144, 146, and 148 in FIG. 5 versus the lengths of arrows 122, 124, 126, 128, 130, and 132 in FIG. 4.

As can be seen by comparing FIGS. 4 and 5, the sinusoidal AC voltage applied to coil 68 via power supply 62, produces a substantially uniform magnetic flux ($\Phi_B$) through an area of metal belt 32 adjacent induction heater 60 that varies in magnitude over time. According to Faraday's law, this varying magnetic flux induces a varying voltage in the area of metal belt 32 adjacent induction heater 60 that is proportional to the rate of change of this magnetic flux ($\Phi_B$). According to Ohm's law, this varying voltage in turn produces a varying current in metal belt 32 that has a magnitude proportional to the induced varying voltage and dependent on the resistance of metal belt 32. This current flows substantially uniformly throughout the area of metal belt 32 through which the magnetic flux ($\Phi_B$) from coil 68 passes and is generally represented at various points on metal belt 32 in FIGS. 4 and 5 by eddy currents $I_1$, $I_2$, $I_3$, $I_4$, $I_5$, and $I_6$ and respective arrows 106, 108, 110, 112, 114, and 116. As this current flows, it substantially uniformly heats the area of the metal belt through which the magnetic flux ($\Phi_B$) passes, this heat is in turn transferred to print medium 23 to dry printing composition deposited thereon by print engine 22.

Figure 6:
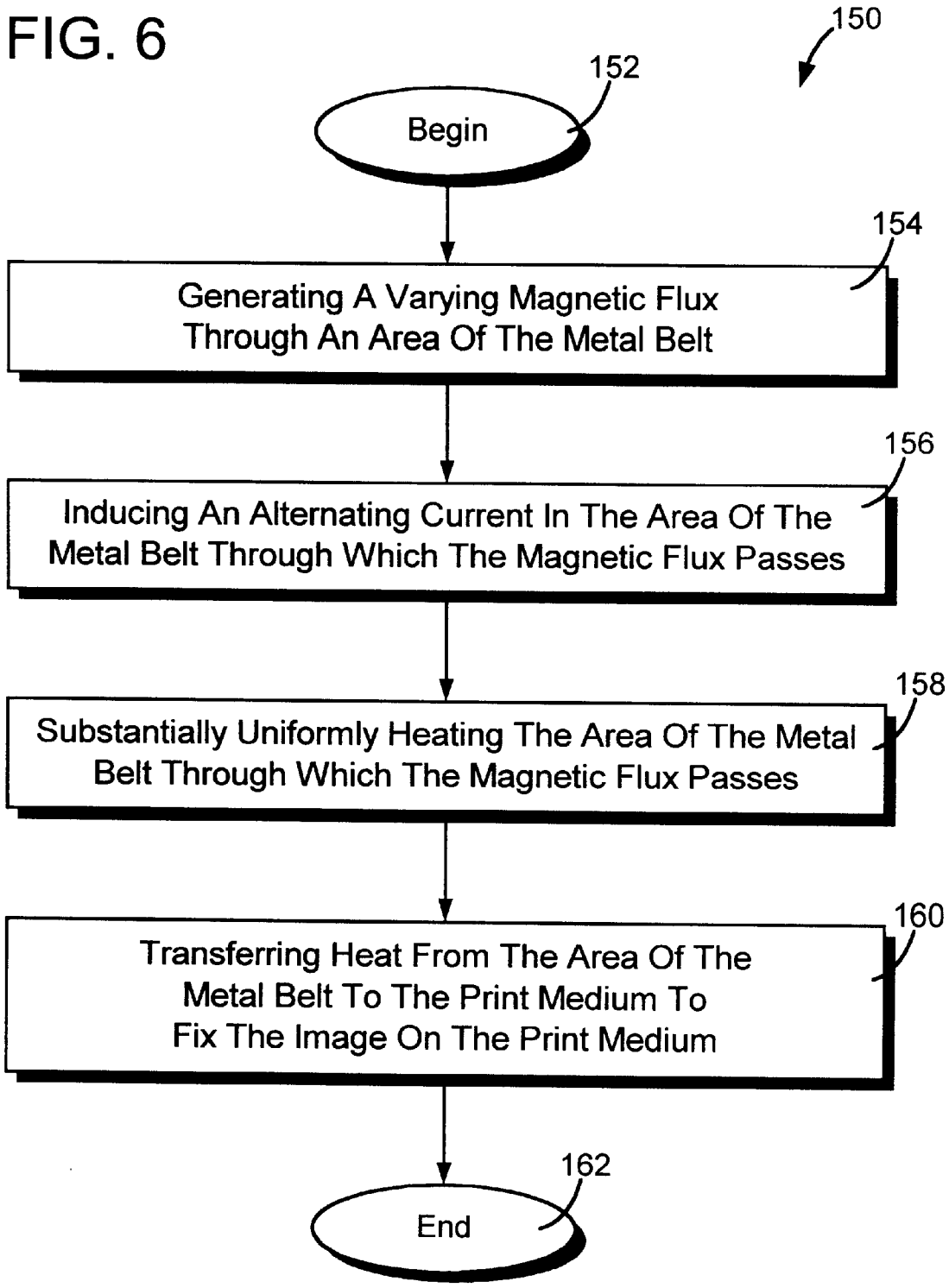
FIG. 6 is a diagram of an embodiment of a method in accordance with the present invention.

A diagram of an embodiment of a method 150 in accordance with the present invention is shown in FIG. 6. As can be seen in FIG. 6, method 150 begins by generating a varying magnetic flux ($\Phi_B$) through an area of metal belt 32, as generally indicated by block 154 in FIG. 6. Next, an alternating current is induced in the area of metal belt 32 through which the magnetic flux ($\Phi_B$) passes, as generally indicated by block 156 in FIG. 6. Next, the area of metal belt 32 through which the magnetic flux passes is substantially uniformly heated, as generally indicated by block 158 in FIG. 6. Next, heat is transferred from the area of the metal belt 32 to print medium 23 to fix the image on print medium 23, as generally indicated by block 160 in FIG. 6. Method 150 then ends 162.

With respect to the above-described embodiment, as well as others in accordance with the present invention, at least the following advantages are noted. The use of a metal belt or other metallic structure for transporting is less expensive and complex to manufacture than a non-metal belt with electrical conductors, such as metallic wire loops, embedded or defined therein. Also, a metal belt or metallic structure for transporting is electrically conductive over its whole surface area, thereby providing more substantially uniform heating throughout than a non-metal belt with electrical conductors embedded or defined therein which tends to provide more localized heating in the areas adjacent the conductors. Additionally, induction heating in accordance with the present invention does not require movement of the metal belt or metallic means for transporting because a varying magnetic flux is generated by changing an intensity and/or direction of a magnetic field through an area of the metal belt or metallic means for transporting. Furthermore, induction heating in accordance with the present invention does not require physical contact between the metal belt and the heating device, as with conductive heating designs, where substantially uniform physical contact is required between the metal belt and the heating device in order for heat transfer to occur. The requirement for such substantially uniform physical contact adds tolerance requirements to such conductive heating device designs. Elimination of the requirement of physical contact for heat transfer to occur and its associated tighter tolerances, helps reduce the complexity and cost of the present invention, as well as increase its operational efficiency.

Although the invention has been described and illustrated in detail, it is to be clearly understood that the same is intended by way of illustration and example only, and is not to be taken necessarily, unless otherwise stated, as an express limitation, nor is it intended to be exhaustive or to limit the invention to the precise form or to the exemplary embodiment(s) disclosed. Modifications and variations may well be apparent to those skilled in the art. Similarly, any method elements described may be interchangeable with other method elements in order to achieve the same result.

For example, in alternative embodiments of the present invention, the applied AC voltage can be other than sinusoidal. The spirit and scope of the present invention are to be limited only by the terms of the following claims.

Reference to an element in the singular is not intended to mean "one and only one" unless explicitly so stated, but rather means "one or more." Moreover, no element or component in the present specification is intended to be dedicated to the public regardless of whether the element or component is explicitly recited in the following claims. Finally, no claim element herein is to be construed under the provisions of 35 U.S.C. Section 112, sixth paragraph, unless the element is expressly recited using the phrase "means for . . . "

What is claimed is:

1. A printing device, comprising:

a printing mechanism for printing an image on a print medium;

a metal belt that moves for transporting the print medium; and an induction heater positioned adjacent the metal belt, the induction heater being configured to induce an alternating current in an area of the metal belt adjacent the induction heater, the heater being configured for inducing uniform amounts of magnetic flux across the belt area thereby to generate in the belt alternating current for uniformly heating the area of the metal belt adjacent the induction heater.

2. The printing device of claim 1, wherein the heater includes a coil of conductive material disposed in a plane that is parallel to the area of the belt, wherein the alternating current is induced in the area of the metal belt adjacent the induction heater irrespective of movement of the metal belt.

3. The printing device of claim 1, wherein the printing mechanism comprises an inkjet printhead.

4. A method for use in a printing device, the printing device including a printing mechanism for printing an image on a print medium and a metal belt that is movable for transporting the print medium, the method comprising:

generating a varying magnetic flux through an area of the movable metal belt so that at any given time the magnetic flux is substantially uniformly distributed across the area;

inducing an alternating current in the area of the metal belt through which the varying magnetic flux passes for substantially uniformly heating the area of the metal belt.

5. The method of claim 4, wherein a magnitude of the magnetic flux is varied through the area of the metal belt.

6. The method of claim 4, wherein a direction of the magnetic flux is varied through the area of the metal belt.

7. The method of claim 4, further comprising transferring heat from the area of the metal belt to the print medium to fix the image on the print medium.

8. The method of claim 4, wherein the alternating current is induced in the area of the metal belt through which the varying magnetic flux passes irrespective of movement of the metal belt.

9. A printing device, comprising:

means for printing an image on a print medium;

metallic means movable for transporting the print medium; and means for generating a uniformly distributed but varying magnetic flux through an area of the metallic means for transporting that induces an alternating current in the area thereby uniformly heating the area.

10. The printing device of claim 9, wherein the means for printing comprises an inkjet printhead.

11. The printing device of claim 9, wherein the metallic means for transporting comprises a metal belt.

12. The printing device of claim 9, wherein the means for generating comprises an induction heater positioned adjacent the metallic means for transporting and on one side of the metallic means.

13. The printing device of claim 9, wherein the alternating current is induced in the area of the metallic means for transporting irrespective of movement of the metallic means for transporting.

14. An inductive heating device for use in a printing device, the printing device including a metal belt having a flat area for transporting the print medium, the inductive heating device comprising:

a power source; and a coil coupled to the power source to produce a varying magnetic field around the coil and positioned in a plane that is parallel to the flat area of the belt and adjacent to the metal belt to induce a uniformly distributed alternating current in the area of the metal belt through which the varying magnetic field passes, the alternating current uniformly heating the area of the metal belt.

15. The inductive heating device of claim 14, in a printing device.

16. The inductive heating device of claim 14, wherein a magnitude of the magnetic field varies.

17. The inductive heating device of claim 14, wherein a direction of the magnetic field varies.

18. The inductive heating device of claim 14, wherein the alternating current is induced in the area of the metal belt irrespective of movement of the metal belt.

19. The device of claim 14 wherein the coil is arranged in a spiral.

20. The device of claim 14 wherein the coil is located on only one side of the metal belt.

* * * * *